US009920530B2

(12) United States Patent
Wadley et al.

(10) Patent No.: US 9,920,530 B2
(45) Date of Patent: Mar. 20, 2018

(54) HEAT-MANAGING COMPOSITE STRUCTURES

(75) Inventors: Haydn N. G. Wadley, Keswick, VA (US); Douglas T. Queheillalt, Charlottesville, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 2596 days.

(21) Appl. No.: 12/596,548

(22) PCT Filed: Apr. 17, 2008

(86) PCT No.: PCT/US2008/060637

§ 371 (c)(1),
(2), (4) Date: May 26, 2010

(87) PCT Pub. No.: WO2008/131105

PCT Pub. Date: Oct. 30, 2008

(65) Prior Publication Data

US 2010/0236759 A1 Sep. 23, 2010

Related U.S. Application Data

(60) Provisional application No. 60/923,880, filed on Apr. 17, 2007.

(51) Int. Cl.

| | |
|---|---|
| ***B60H 1/00*** | (2006.01) |
| ***E04C 2/34*** | (2006.01) |
| ***E04C 2/36*** | (2006.01) |

(52) U.S. Cl.

CPC ..... *E04C 2/34* (2013.01); *E04C 2/3405* (2013.01); *E04C 2/365* (2013.01); *E04C 2002/345* (2013.01); *E04C 2002/3455* (2013.01); *E04C 2002/3472* (2013.01); *E04C 2002/3488* (2013.01)

(58) Field of Classification Search

CPC ..... E04C 2/34; E04C 2/3405; E04C 2/365; E04C 2002/345; E04C 2002/3455; E04C 2002/3472; E04C 2002/3488

USPC ..... 165/41, 165, 179, 168, 169, 170, 171, 165/185, 80.1, 80.2, 80.3, 104.21, 907, 165/133; 361/704; 52/506.01, 633; 228/181, 193; 428/73, 116, 593

See application file for complete search history.

(56) References Cited

U.S. PATENT DOCUMENTS

| | | | | |
|---|---|---|---|---|
| 6,994,155 | B2 * | 2/2006 | Dessiatoun et al. | 165/165 |
| 7,166,237 | B2 | 1/2007 | Klett et al. | |
| 2004/0123980 | A1 | 7/2004 | Queheillalt et al. | |

(Continued)

OTHER PUBLICATIONS

Wadley, H.N.G, "Multifunctional periodic cellular metals," Phil. Trans. R. Soc. A., 2006, vol. 364, pp. 31-68.

*Primary Examiner* — Travis Ruby
(74) *Attorney, Agent, or Firm* — Vorys, Sater, Seymour and Pease LLP; Vincent M DeLuca

(57) ABSTRACT

Light-weight, heat-managing structures feature open-cell lattice, honeycomb, and/or corrugated (prismatic) arrangements in their substructures, combined with heat pipe/heat plate arrangements for managing heat to which the structures are subjected. The structures are well suited to aerospace applications and may be employed in the leading edge of wings or other airfoil-shaped components; gas turbine engine components; rocket nozzles; and other high-heat, high-stress environments.

29 Claims, 8 Drawing Sheets

(56) References Cited

U.S. PATENT DOCUMENTS

| | | | | |
|---|---|---|---|---|
| 2004/0154252 | A1 | 8/2004 | Sypeck et al. | |
| 2005/0266163 | A1 | 12/2005 | Wortman et al. | |
| 2006/0163319 | A1 | 7/2006 | Ervin et al. | |
| 2007/0102140 | A1* | 5/2007 | Tuma et al. | 165/80.3 |
| 2008/0149304 | A1* | 6/2008 | Slaughter | 165/80.2 |

* cited by examiner

HEAT-MANAGING COMPOSITE STRUCTURES

CROSS-REFERENCE TO RELATED APPLICATIONS

This application is based on and claims priority benefit of U.S. provisional application No. 60/923,880 filed Apr. 17, 2007, the entire contents of which are incorporated by reference.

FIELD OF THE INVENTION

In general, the invention relates to structural engineering. More particularly, the invention relates to structures that are adapted to manage high heat loads as well as to handle large static and dynamic forces. The inventive structures are particularly suited for aerospace applications.

BACKGROUND OF THE INVENTION

Aerospace vehicles have many components that are subjected to high thermal and mechanical loading. For example, as a hypersonic vehicle travels through the earth's atmosphere, the high local heating and aerodynamic forces cause extremely high temperatures, severe thermal gradients, and high stresses. Stagnation regions, such as wing and tail leading edges and nose caps, are critical design areas. These regions experience the highest thermal gradients and mechanical stresses compared with other vehicle components Gas turbine engine components—particularly stator and rotor blades—also experience extremely high mechanical and/or thermal loading. In general, a gas turbine engine includes, in sequential order, a compressor section, a combustion chamber, and a turbine section. Incoming air is highly compressed in the compressor section by an alternating series of rotating and stationary bladed disks; mixed with fuel and ignited in the combustion chamber; and then exhausted out of the engine through the turbine section, which also includes an alternating series of rotating and stationary disks. The engine may further include a fan in front of the compressor, which fan helps draw air into the engine. Because the various rotating components spin at such at high rotational velocities, their blades are subjected to very large, radially outwardly directed tensile loads. Additionally, the blades are often impacted by solid objects (e.g., birds) that are drawn into the engine, and therefore they must be able to withstand transient dynamic impact loading as well.

Still further, the blades—particularly those in the turbine section—may be subjected to temperatures on the order of 1000° C. to 1500° C. Therefore, they are usually made from highly creep resistant metallic alloys (so-called superalloys). Additionally, as jet engines have been designed to operate at higher and higher temperatures, it has become necessary to cool the blades and other components in some fashion and to limit the thermal flux that enters the various components through the use of thermal barrier coatings (TBC's). Such coatings, however, are not perfectly reliable in all cases, so the engine components must be able to continue functioning even after a portion of the TBC spalls.

Moreover, the hollow structure of hot engine section turbine blades is used to introduce cooling air into the interior of the blade. It is then allowed it to exit the blade/vane through an array of small holes, thus creating a cooling film on the blade surface. This enables an increase in the operating temperature of the engine while maintaining the temperature of the blade material below that which results in service failure (by oxidation, hot corrosion or creep/fatigue), even when TBC spalling occurs. Oxidation- and hot corrosion-resistant coatings are beginning to be widely used to slow the degradation of blades and other hot engine section components in gas turbine engines. The thermally insulating ceramic coatings applied on top of these layers reduce the blade metal surface temperature and therefore the rate of degradation during service.

In addition to these heat and strength considerations, it is also important that aerospace components be as light as possible because a heavier a vehicle has higher fuel costs associated with it. Additionally, heavier rotating engine components have higher rotational inertia and are therefore less responsive (i.e., they take longer to spool up or spool down) than lighter components.

Thus, these considerations present intricate design challenges to an aerospace engineer.

SUMMARY OF THE INVENTION

The present invention provides novel structures that have high static and dynamic strength, that are light weight, and that are able to manage intense thermal loading effectively. They are therefore well suited to aerospace applications. Embodiments of the invention utilize the multifunctional behavior of cellular core panel structures to improve the performance of jet engine blades, disks, and blisks; rocket engines; and leading edges of orbital and/or hypersonic aerospace vehicles where high thermal fluxes and mechanical stresses can be encountered (for example, during reentry).

Thus, embodiments of the invention include rocket engine nozzles and engine discs with simple curvatures; blades/vanes with twisted airfoil topologies; and leading edge structures for hypersonic vehicles. These structures are constructed from cellular core panels with either solid or sandwich-panel outer faces. In the latter configuration, the sandwich panel is arranged as a thermal (i.e., heat plate) spreading system. The cellular cores can be fabricated from solid or hollow struts and are arranged to maximize the support of dynamic and static stresses, and they facilitate cross-flow heat exchange with cooling gases. The structures can be fabricated by first creating a core substructure including an array of trusses that are either solid or hollow. When hollow trusses are employed, they may be in the form of conventional and/or micro heat pipes that are able to efficiently and rapidly transfer heat in their axial directions. Such truss arrays are flexible when free-standing, and they can be elastically or plastically distorted to fit onto a complexly curved surface without loss in ultimate mechanical or thermal performance. The array of trusses may be bonded to curved faces by diffusion bonding; brazing; other transient liquid phase bonding methods; welding of all types; or by any other convenient means of robust attachment.

In one approach, an embodiment of the present invention provides heat plates to spread heat uniformly across the surface of a structure. This heat is then transported, by predominantly conduction or convection, to a cellular lattice structure that also can be made of heat pipes (or conventional materials), where it is dissipated to a cooling flow. Alternatively, a thermal protection system is used to impede the flow of heat into the system described above. This reduces the heat flux that must be dissipated to the cooling flow.

In another approach, lattice-type structures are provided as lateral strain isolators so that thermal displacements created in hot regions of the system do not cause large stresses in other parts of the structure. This improves the cyclic thermal life of the structure.

Due to their open nature, various lattice materials can be designed to have low flow-resistant pathways in the structure. Manufacturing the struts of the lattice cores from high thermal conductivity materials increases the thermal conduction from a hot surface into the open lattice structure. This enables sandwich panels with cellular cores to function as highly efficient cross-flow heat exchangers while simultaneously providing mechanical strength to the overall structure. They are therefore excellent candidates for creating multifunctional structures combining load support and thermal management.

The heat pipe concepts disclosed herein can be extended to sandwich plate or lattice truss structures by applying wicking material to the webs of a perforated honeycomb or corrugated (prismatic) structure or to the inside of a hollow tube. In the former case, the addition of hermetic face sheets then creates a closed system which can be used to spread heat from hot regions of a plate type structure. In the case of heat pipes, on the other hand, the tubes can be configured as cellular lattice structures to form a structural core, and the addition of hermetic face sheets then creates a closed system which can be used to spread heat into an open lattice configuration. That heat can be easily removed by cross-flow heat exchange principles. In both cases, the resulting systems possess very high specific strength and very high thermal transport rates.

BRIEF DESCRIPTION OF THE DRAWINGS

The invention will now be described in greater detail in connection with the Figures, in which.

EMBODIMENTS OF THE INVENTION

Structures according to the invention utilize thermal management concepts including heat plate and/or heat pipe concepts. Additionally, they utilize cellular and/or lattice-type, metal structural arrangements. Accordingly, it is beneficial to explain such concepts and structures before describing structural embodiments according to the invention which utilize them.

Figure 1:
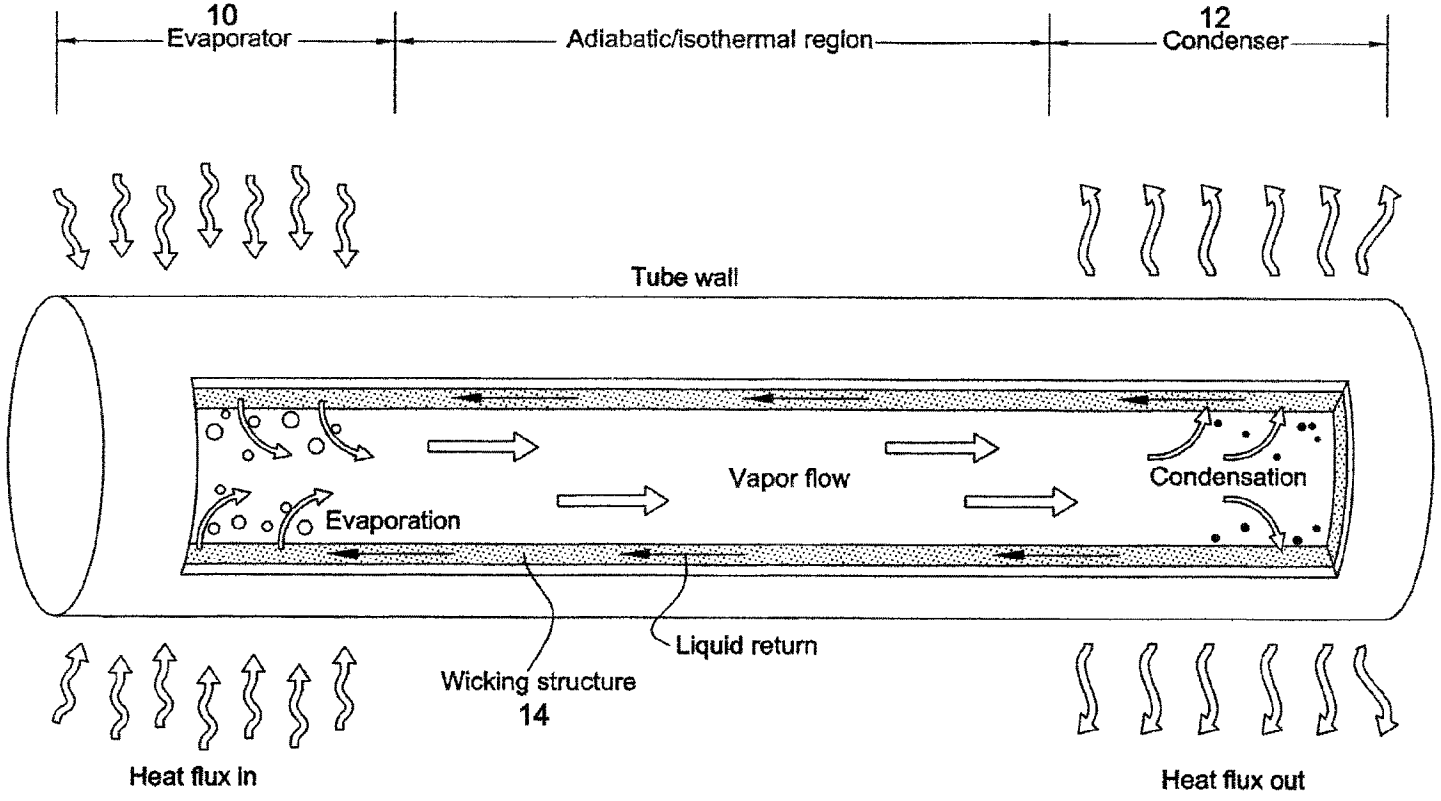
FIG. 1 is a schematic illustration of a heat pipe, as may be incorporated in embodiments of the invention.
Figure 2A:
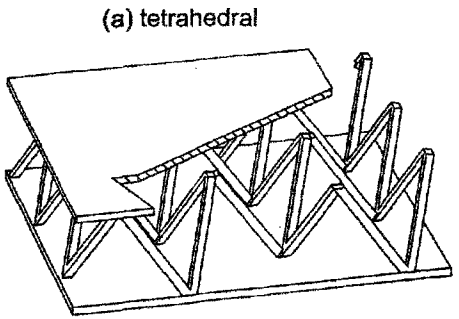
FIGS. 2*a*-2*f* are schematic illustrations of open cell lattice structural arrangements, as may be incorporated in embodiments of the invention.
Figure 2B:
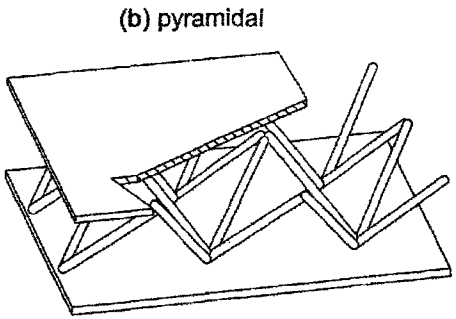
Figure 2C:
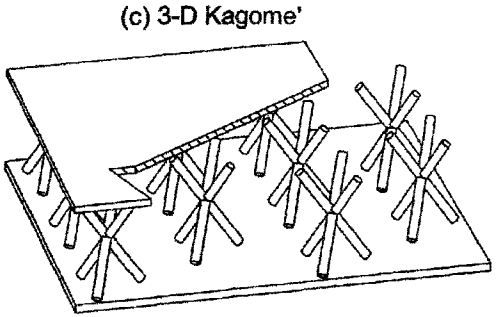
Figure 2D:
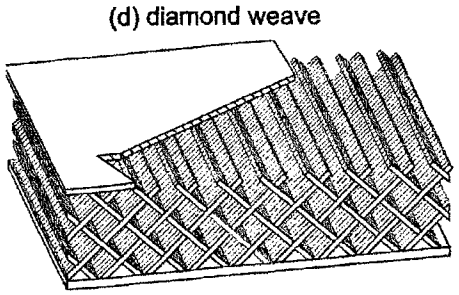
Figure 2E:
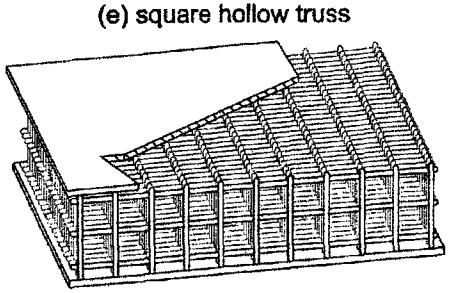
Figure 2F:
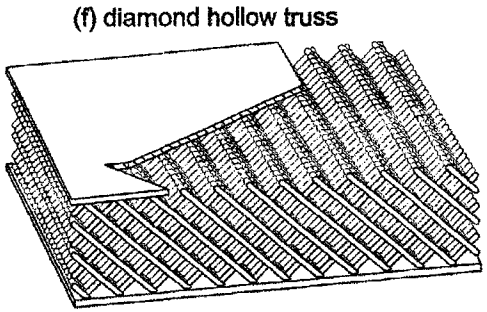

First, a heat pipe or heat plate is a sealed system which transfers heat nearly isothermally via the evaporation and condensation of a working fluid. For example, a basic heat pipe arrangement is illustrated schematically in FIG. 1. As illustrated, heat is absorbed in the hot region or evaporator portion 10 of the heat pipe, which causes working fluid contained therein to vaporize. Vaporized working fluid will thus hold the latent heat of vaporization. The evaporation results in a slight internal pressure differential within the heat pipe, which causes the vapor to flow rapidly from the evaporator region 10 to the condenser region 12 where the vapor condenses and releases the latent of heat condensation. A suitable wick 14 is used to create capillary pumping of the working fluid to return it to the locally heated evaporator region 10. Thus, a heat pipe serves as a means for very rapidly transporting thermal energy away from a point of application to a point where it can be dissipated more effectively and for "isothermalizing" a structure.

Next, cellular metals and simple methods for making them have been developed. Open cell, lattice structures have been found to be highly efficient load-supporting structures—especially those associated with carrying bending loads when configured as the core of a sandwich panel. Examples of such open cell, lattice structures are shown in FIGS. 2*a*-2*f*, which respectively show a tetrahedral structural arrangement; a pyramidal structural arrangement; a three-dimensional Kagomé structural arrangement; a diamond or textile weave structural arrangement; a square, collinear hollow truss structural arrangement; and a diamond, collinear hollow truss structural arrangement. These arrangements exhibit excellent impact energy absorption characteristics and have been shown to be very effective at withstanding high intensity dynamic loads. Methods for fabricating planar and curved structures from titanium-, iron-, nickel-, copper-, and aluminum-based alloys have all been reported, and methods for the fabrication of similar structures from composites and ceramics of all types have also been envisioned. Other open cell lattice topologies may, of course, be employed within the context of the invention.

Further structural arrangements that may be employed in the context of the invention are honeycomb structures and corrugated (prismatic) structures. Exemplary honeycomb structures include hexagonal cell (FIG. 3*a*), square cell (FIG. 3*b*), and triangular cell (FIG. 3*c*) structures. Exemplary corrugated structures include triangular corrugation (FIG. 4*a*), diamond or multi-layered corrugation (FIG. 4*b*), and flat-top or Navtruss® corrugation arrangements. Other honeycomb or corrugated structural arrangements may, of course, be employed.

Turning now more specifically to the application of these concepts according to the present invention, a passive, multifunctional heat pipe leading edge would greatly reduce the severe thermal gradients, and corresponding mechanical stresses, experienced during re-entry of an orbital vehicle or by a hypersonic vehicle during atmospheric travel. This may be accomplished using heat pipes to cool the stagnation region by transferring heat to surface locations aft of the stagnation region, thereby raising the temperature aft of the stagnation region above the expected radiation equilibrium temperature. When applied to leading-edge cooling, heat pipes operate by accepting heat at a high rate over a small area near the stagnation region and radiating it at a lower rate over a larger surface area. The use of heat pipes results in a nearly isothermal leading edge surface, thus reducing the temperatures in the stagnation region and raising the temperatures of both the upper and lower aft surfaces.

Figure 3B:
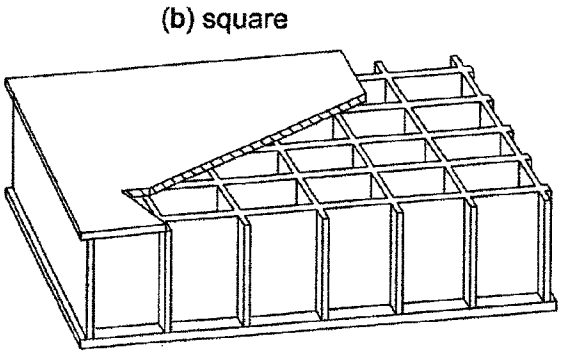
FIG. 3*a*-3*c* are schematic illustrations of honeycomb structures, as may be incorporating in embodiments of the invention.
Figure 3C:
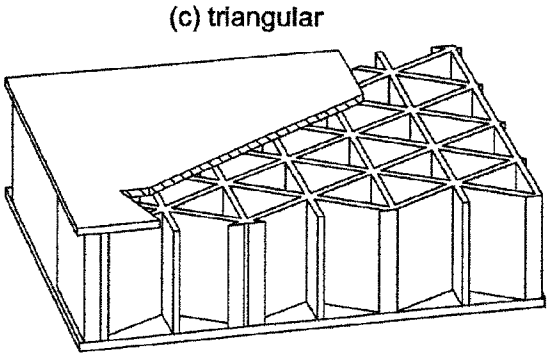
Figure 3A:
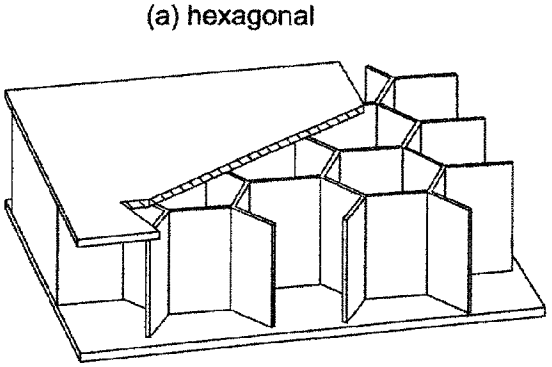
Figure 4B:
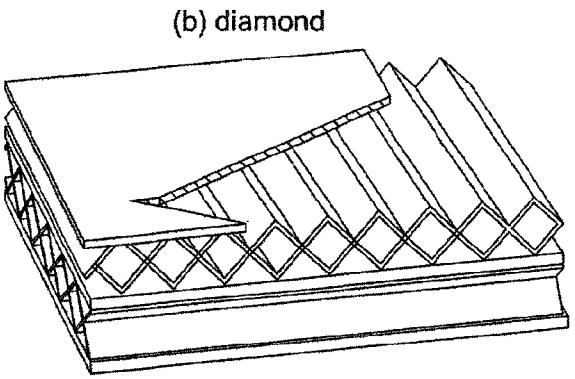
FIGS. 4*a*-4*c* are schematic illustrations of corrugated (prismatic) structures, as may be incorporating in embodiments of the invention.
Figure 4C:
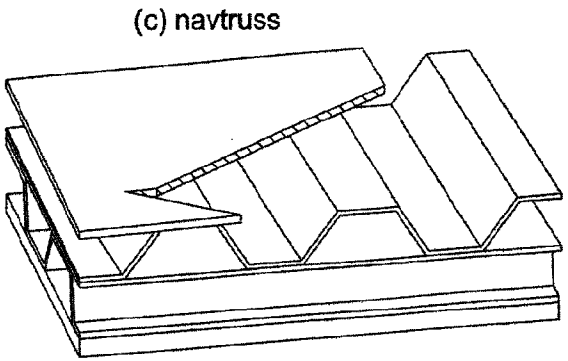
Figure 4A:
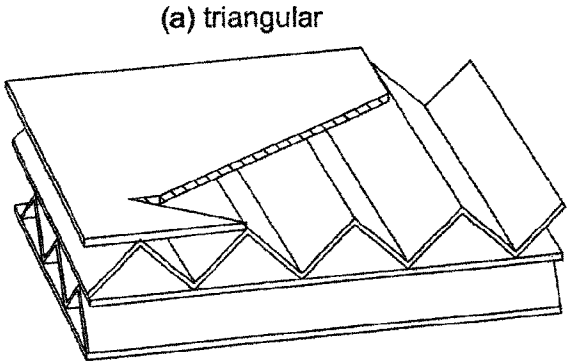
Figure 5:
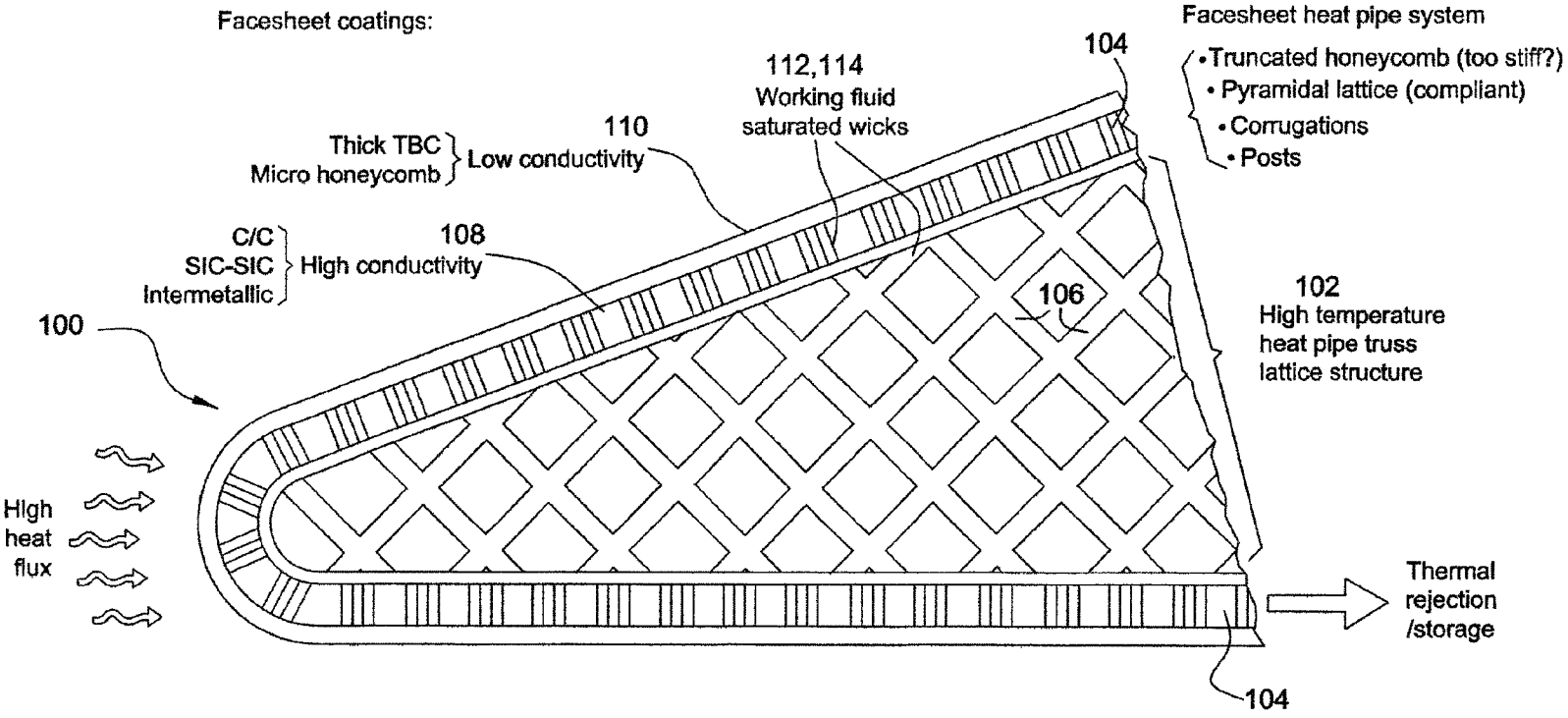
FIG. 5 is a schematic illustration of one embodiment of a heat-managing composite structure according to the invention, which structure may be used in leading edges of wings or other airfoil-shaped components; gas turbine engine components; rocket nozzles; and other high-heat, high-stress environments.

One example 100 of such a structural arrangement, which may be utilized in the leading edge or over the entire extent of the wing if desired, is illustrated in FIG. 5. The structural arrangement 100 includes an open-cell, lattice core 102 and an outer, skin or surface layer 104. The lattice core 102 is suitably constructed from a network of interconnected solid struts 106 constructed according to any of the arrangements shown in FIGS. 2*a*-2*f*, and the skin or surface layer 104 is suitably fabricated as a laminated, sandwich-type structure. More particularly, a honeycomb structure such as shown in FIGS. 3*a*-3*c*—e.g., a perforated web honeycomb—may be used to form the "skeleton" 108 of the skin layer 104, which thereby provides a heat plate facesheet for the exterior surface of the overall structure 100. Alternatively, lattice-type structures, e.g. as shown in FIGS. 2*a*-2*f*, or corrugated structures, e.g. as shown in FIGS. 4*a*-4*c*, may be used to form the core or skeleton 108 of the skin layer 104, depending on the particular mechanical strength requirements of the component and/or component geometries.

For hypersonic vehicle applications, the very outermost surface 110 of the skin layer 104 is suitably provided as a low thermal conductivity material, e.g., a thick TBC or micro-honeycomb material of some sort, to limit the amount of heat that reaches the core portion 102 of the structure 100. On the other hand, the core or skeleton 108 of the skin layer 104 is suitably manufactured from high thermal conductivity material—e.g. carbon/carbon, silicon-carbon/silicon-carbon, or intermetallic material—to facilitate the transport away of heat that does penetrate into the skin layer 108.

Furthermore, working fluid-saturated wicks 112, 114 are provided in the interstices of the honeycomb or lattice skeleton of the skin layer 104 as well as in the interstices of the lattice structure of the core 102. Thus, with the overall structure 100 shown in FIG. 5, thermal spreading and cross-flow heat exchange can be obtained, with the skin layer 104 being designed for heat plate-type heat exchange and the core 102 designed for thermal spreading within the interior of the structure 100. The solid struts 106 of the core 102 increase the heat transfer within the lattice via conduction and the surface area available to remove heat via convection within the structure.

As noted, such a structural arrangement may exemplarily be utilized as the leading edge of a hypersonic or orbital vehicle. Additionally, such structure may be utilized for gas turbine engine components, in which case the subcomponents likely would be fabricated from typical superalloy material, or rocket engine components, in which case the components likely would be fabricated from copper alloys.

Figure 6:
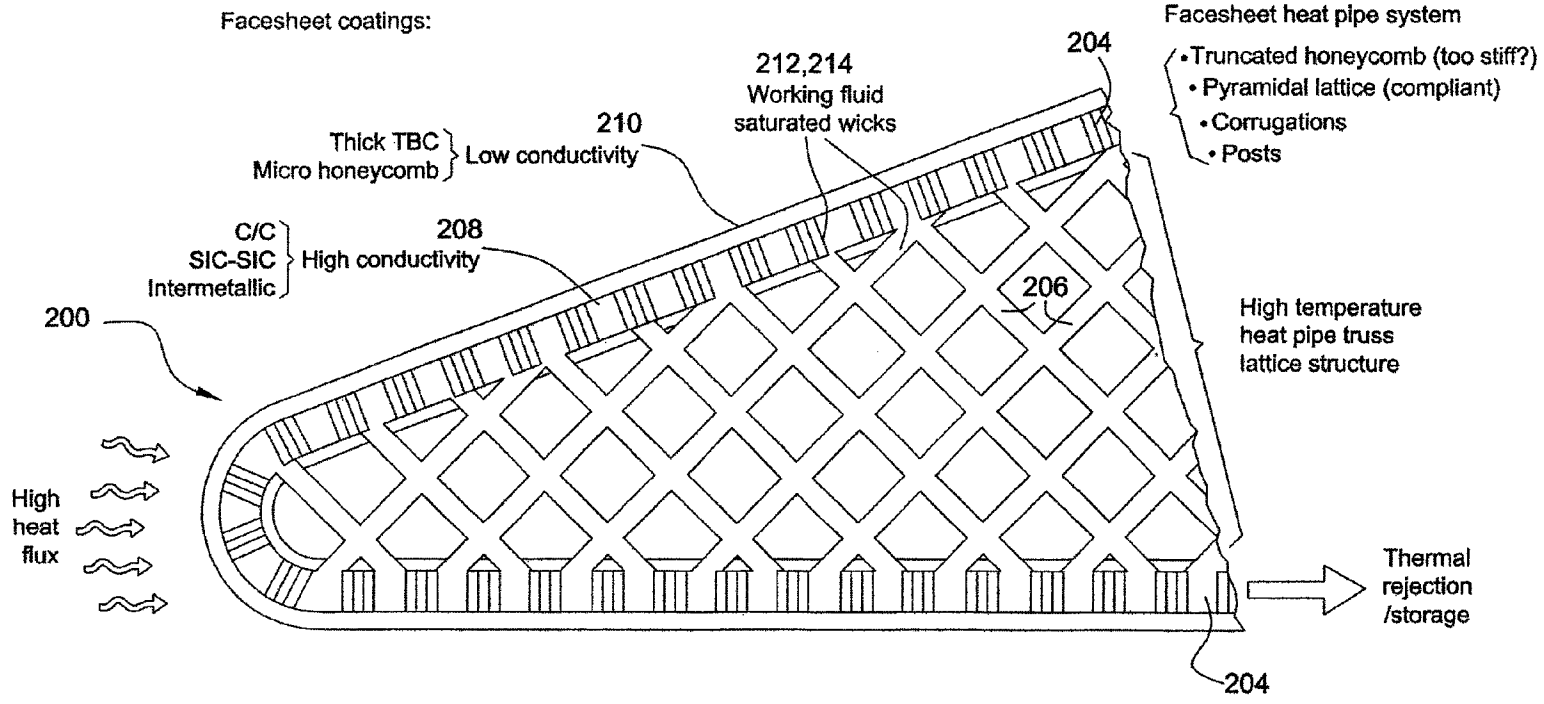
FIG. 6 is a schematic illustration of a second embodiment of a heat-managing composite structure according to the invention that is generally similar to the embodiment shown in FIG. 5, which structure may be used in leading edges of wings or other airfoil-shaped components; gas turbine engine components; rocket nozzles; and other high-heat, high-stress environments.

Another example 200 of such a structural arrangement, which may be utilized in the leading edge or over the entire extent of the wing if desired, is illustrated in FIG. 6. The structure 200 is generally the same as the structure 100 shown in FIG. 5, and corresponding components and sub-components are labeled with corresponding reference numerals that have been incremented by 100. The primary difference between the structure 200 and the structure 100 is that the struts 206 are hollow, not solid, and have heat pipe components similar to those illustrated generically in FIG. 1 integrated therein. The heat plate and heat pipe interior structure 204, 206 is suitably coated with a high temperature wicking material such as a foam, and a working fluid such as water, methanol, alkali metals, silver, etc., is used to transfer heat by vapor phase transport. The structure 200, including its potential applications and corresponding materials from which it is fabricated, is otherwise the same as the structure 100.

In operation, either of the structural arrangements 100, 200 spreads thermal energy that has been applied locally to the outer surface of the structure, thereby creating a near isothermal outer structure. This reduces the maximum temperature experienced by the component and may enable increases in the overall operating temperature of the wing, engine, rocket nozzle, etc. When a cooling gas or fluid or phase change material is available, the transfer of thermal energy to this gas or fluid or phase change material will be increased because the product of the temperature difference between the structure and coolant and the area of contact between the cooling medium and the cellular heat pipe/plate system is increased.

Figure 7:
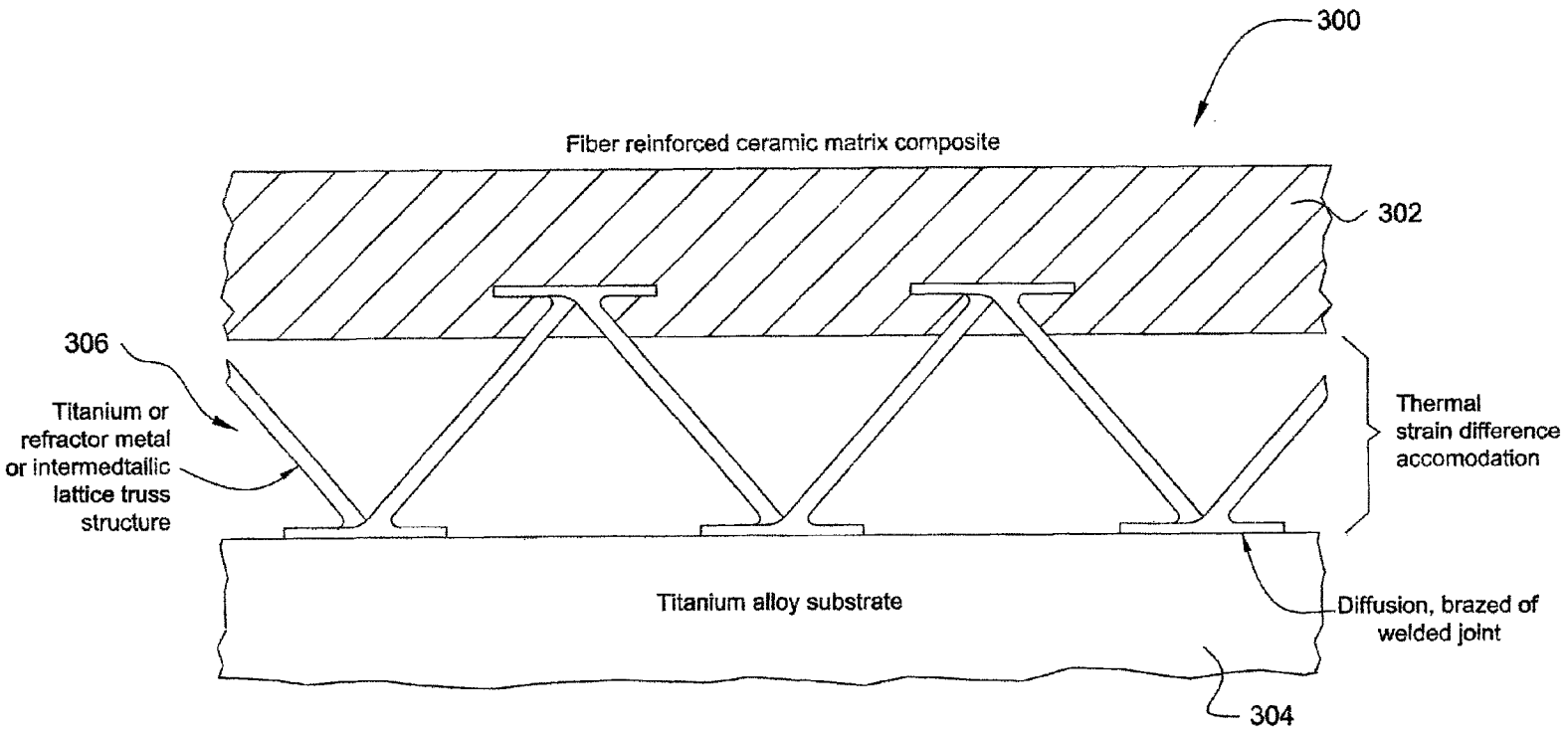
FIG. 7 is a schematic illustration of a third embodiment of a heat-managing composite structure according to the invention, which structure may be used in leading edges of wings or other airfoil-shaped components; gas turbine engine components; rocket nozzles; and other high-heat, high-stress environments.

Another exemplary structure 300 according to the invention is illustrated in FIG. 7. According to this arrangement, a protective, hot outermost or "face" layer 302 of the structure is joined to and spaced from an underlying substrate 304 (e.g., the titanium or aluminum sub-skin of an aerospace vehicle) by a solid strut cellular structure or a heat pipe-type strut cellular structure 306, which may suitably be configured as illustrated above in FIGS. 2*a*-2*f* or, alternatively, as a corrugated structure as shown in FIGS. 4*a*-4*c*. The face layer 302, which thermally protects the underlying sub-structure, is fabricated from a low thermal conductivity material such as fiber-reinforced, ceramic matrix composite, TBC-type material, a closed cell cellular structure made of a low thermal conductivity material, etc. The cellular lattice structure 306, on the other hand, may be fabricated from material such as titanium, refractory metals, or intermetallic materials. As illustrated, outermost portions of the truss structure 306 are suitably embedded within the face layer 302, whereas inner portions of the truss structure 306 are suitably joined to the substrate 304 by techniques such as diffusion bonding, brazing, welding of all types, other transient liquid phase bonding methods, or by any other convenient means of robust attachment.

Furthermore, coolant material is located in the interstices of the truss structure 306. More particularly, the coolant material may be cooling flow of gas or liquid, or it may be some other phase change material that fills the open spaces between the trusses of the cellular structure.

With this arrangement 300, the low thermal conductivity material of the face layer 302 minimizes or reduces the thermal flux transported into the underlying structure. The heat that does propagate through the thermal insulator is dispersed by the cellular structure 306 and is then removed by the coolant located in the interstices between the trusses. Furthermore, cellular interconnecting structures 306, fabricated like those shown in FIGS. 2*a*-2*f* or FIGS. 4*a*-4*c*, can accommodate the thermal expansion displacement resulting from a difference in thermal expansion coefficient-temperature product between the outer thermal protection face layer 302 and the sub-structure 304 to be protected. It does this by in-plane stretching without causing large stresses, which can fracture the system. It is noted that any of the structures shown in FIGS. 2*a*-2*f* or FIGS. 4*a*-4*c* will accommodate the thermal expansion displacement; it is further noted that the open cell lattices shown in FIGS. 2*a*-2*f* will accommodate in-plane stretching (strain) in two-dimensions, while the prismatic lattices shown in FIGS. 4*a*-4*c* will accommodate in-plane stretching (strain) in one-dimension.

Thus, more generally, such a thermal protection concept reduces the heat flow into the interior of the structure. The heat that does reach the cellular structure is then spread across the heat pipe structure and transferred to the coolant material for removal from the system. The cellular lattice structure can be used to isolate the displacements arising from thermal expansion of the outer material from the substrate; this will increase the thermal cyclic life of the system and allow operation in very high thermal flux environments.

Figure 8:
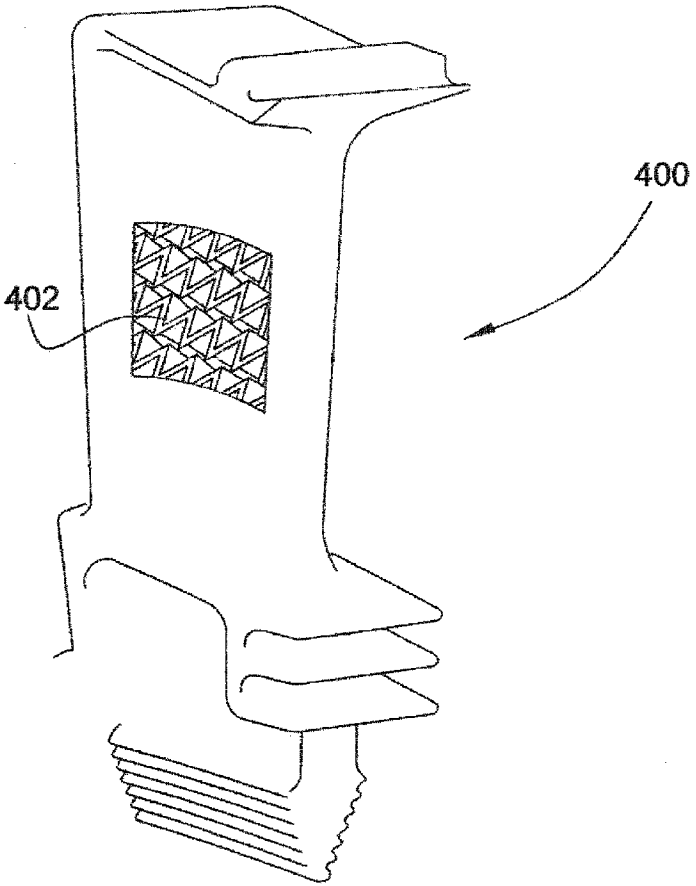
FIG. 8 is a schematic illustration of a turbine engine component (e.g., a rotor or stator blade) employing structures as disclosed in FIG. 5, 6, or 7.

Finally, as alluded to above, the various structures described herein may be employed in gas turbine engine components. Such an application is illustrated in FIG. 8. This embodiment of the invention features a blade 400, which may be a rotor blade or a stator blade for the turbine section of the engine. The disclosed construction could also be used for a guide van in the turbine section of the engine. (Still further, the disclosed construction could be used for the compressor rotor or stator blades if desired, although the heat-managing characteristics of this construction are not as important in the compressor section of the engine since the components are not subjected to temperatures as high as those to which the turbine section components are subjected.) In this blade embodiment 400, the blade is hollow and has a lattice-type core 402 that is configured, for example, as illustrated in any of FIGS. 2*a*-2*c*. The lattice-type core enhances structural efficiency of the blade, improves impact resistance, and facilitates cross-flow heat exchange between cooling air that flows through the interior of the blade and the hot skin structure of the blade. The concept can be extended to turbine disks/blisks and rocket nozzle components.

The foregoing disclosure is only intended to be exemplary of the apparatus of the present invention. Departures from and modifications to the disclosed embodiments may occur to those having skill in the art. The scope of the invention is set forth in the following claims.

We claim:

1. A structural arrangement, comprising:

an open-cell lattice-structure core;

a surface layer comprising a cellular sub-structure; and a heat-transferring working fluid disposed within said core or said surface layer;

wherein the surface layer further comprises an outer arrangement that has lower thermal conductivity than the cellular sub-structure of said surface layer.

2. The structural arrangement of claim 1, wherein a heat-transferring working fluid is disposed within each of said core and said surface layers.

3. The structural arrangement of claim 1, wherein the lattice structure of said core is selected from the group consisting of tetrahedral, pyramidal, three-dimensional Kagome; diamond or textile weave; square, collinear hollow truss; and diamond, collinear hollow truss structural arrangements.

4. The structural arrangement of claim 1, wherein the lattice structure of said core is formed from solid struts.

5. The structural arrangement of claim 4, wherein said heat-transferring working fluid is present in wicking material disposed within the interstices of the lattice structure of said core.

6. The structural arrangement of claim 1, wherein the lattice structure of said core is formed from hollow struts.

7. The structural arrangement of claim 6, wherein said heat-transferring working fluid is disposed within said hollow struts in a manner such that the hollow struts function as heat pipes.

8. The structural arrangement of claim 7, wherein said heat-transferring working fluid is present in wicking material disposed within said hollow struts.

9. The structural arrangement of claim 1, wherein the cellular sub-structure of said surface layer is an open-cell lattice structure.

10. The structural arrangement of claim 9, wherein the open-cell lattice structure of said surface layer is selected from the group consisting of tetrahedral, pyramidal, three-dimensional Kagome; diamond or textile weave; square, collinear hollow truss; and diamond, collinear hollow truss structural arrangements.

11. The structural arrangement of claim 1, wherein said heat-transferring working fluid is disposed within interstices of the cellular sub-structure of the surface layer.

12. The structural arrangement of claim 1, wherein the outer arrangement consists of a thermal barrier coating.

13. The structural arrangement of claim 1, wherein the cellular sub-structure of the surface layer is fabricated from carbon/carbon, silicon-carbon/silicon-carbon, or intermetallic material.

14. The structural arrangement of claim 1, wherein said arrangement is incorporated in the leading edge of a wing or other airfoil-shaped body.

15. The structural arrangement of claim 1, wherein said arrangement is incorporated in a component of a gas turbine engine.

16. The structural arrangement of claim 15, wherein said component is a stator or rotor blade.

17. A structural arrangement, comprising:

a substrate; and an outermost face layer spaced from and joined to the substrate by means of a cellular structure, the outermost face layer being fabricated from a material having a thermal conductivity that is lower than a thermal conductivity of said cellular structure.

18. The structural arrangement of claim 17, wherein the outermost face layer is fabricated from fiber-reinforced, ceramic matrix composite; thermal barrier composition; or a closed cell structure made from a material having a thermal conductivity that is lower than a thermal conductivity of said cellular structure.

19. The structural arrangement of claim 17, wherein the cellular structure comprises an open-cell lattice structure.

20. The structural arrangement of claim 19, wherein the open-cell lattice structure is selected from the group consisting of tetrahedral, pyramidal, three-dimensional Kagome; diamond or textile weave; square, collinear hollow truss; and diamond, collinear hollow truss structural arrangements.

21. The structural arrangement of claim 19, wherein the lattice structure is formed from solid struts.

22. The structural arrangement of claim 19, wherein the lattice structure is formed from hollow struts.

23. The structural arrangement of claim 22, wherein the hollow struts are filled with heat-transferring working fluid.

24. The structural arrangement of claim 23, further comprising wicking material disposed within said hollow struts.

25. The structural arrangement of claim 17, wherein the cellular structure is a corrugated or prismatic structure.

26. The structural arrangement of claim 25, wherein the corrugated or prismatic structure is selected from the group consisting of triangular, diamond, and Navtruss® corrugation arrangements.

27. The structural arrangement of claim 17, wherein portions of said cellular structure are embedded within the outermost face layer.

28. The structural arrangement of claim 17, wherein said cellular structure is diffusion bonded, brazed, or welded to said substrate.

29. The structural arrangement of claim 17, further comprising a phase change material disposed within interstices of the cellular structure.

* * * * *